US009954296B2

(12) United States Patent
Haensgen et al.

(10) Patent No.: US 9,954,296 B2
(45) Date of Patent: Apr. 24, 2018

(54) CONNECTOR WITH SLIDING TAP

(71) Applicant: Rockwell Automation Technologies, Inc., Mayfield Heights, OH (US)

(72) Inventors: Steven T. Haensgen, Mukwonago, WA (US); John P. Caspers, Racine, WI (US); Yutao Wang, Brookfield, WI (US); Jeffrey A. Kilburn, Hartland, WI (US); Darryl E. Whitley, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 15/204,471

(22) Filed: Jul. 7, 2016

(65) Prior Publication Data

US 2018/0013220 A1 Jan. 11, 2018

(51) Int. Cl.
*H01R 12/79* (2011.01)
*H01R 4/24* (2018.01)
*H01R 13/502* (2006.01)

(52) U.S. Cl.
CPC ..... *H01R 12/79* (2013.01); *H01R 4/2454* (2013.01); *H01R 13/502* (2013.01)

(58) Field of Classification Search
CPC ..... H01R 4/2433; H01R 4/2404
USPC ..... 439/417, 409, 492–494
See application file for complete search history.

(56) References Cited

U.S. PATENT DOCUMENTS 4,095,862 A 6/1978 Hatch
4,241,970 A * 12/1980 Rider, Jr. ..... H01R 13/112 439/403
4,252,396 A 2/1981 Wilson
4,359,257 A 11/1982 Lopinski et al.
4,460,228 A * 7/1984 Lane ..... H01R 12/675 439/409
4,641,904 A 2/1987 Kosugi et al.
4,773,876 A 9/1988 Nakamura et al.
5,059,137 A * 10/1991 Dale ..... H01R 12/675 439/395
5,242,313 A 9/1993 Logerot et al.
5,242,314 A 9/1993 Di Giulio et al.
6,019,627 A * 2/2000 Embo ..... H01R 4/2433 439/405
6,074,238 A 6/2000 DeRoss et al.
6,142,815 A * 11/2000 Whiteman, Jr. ..... H01R 9/24 439/381
6,196,863 B1 * 3/2001 Schwant ..... H01R 12/67 439/417
6,232,557 B1 5/2001 Lounsbury et al.
6,394,833 B1 5/2002 Bulmer et al.
6,425,770 B1 7/2002 Lostoski et al.
6,935,885 B2 8/2005 Scherer et al.
(Continued)

FOREIGN PATENT DOCUMENTS

EP 1983616 A2 10/2008

*Primary Examiner* — Tulsidas C Patel
*Assistant Examiner* — Marcus Harcum
(74) *Attorney, Agent, or Firm* — Timothy P. Boppre

(57) ABSTRACT

The disclosed embodiments relate generally to a modular connector for a multi-conductor ribbon cable provided for power and data transmission to a network of devices. The modular connector is coupled to the conductors in the ribbon cable by insulation displacement members. The connector contains both fixed and movable conductor punches used to configure a network interface.

20 Claims, 10 Drawing Sheets

(56) References Cited

U.S. PATENT DOCUMENTS

| | | | | |
|---|---|---|---|---|
| 7,112,073 | B2 | 9/2006 | Morlok | |
| 8,512,065 | B2 * | 8/2013 | Byrne | H01R 4/2433 439/391 |
| 8,678,852 | B2 * | 3/2014 | Rineau | H01R 4/2408 439/402 |
| 8,714,996 | B2 * | 5/2014 | Bishop | H01R 4/2433 439/397 |
| 9,450,314 | B2 * | 9/2016 | Braun | H01R 12/67 |
| 2004/0198090 | A1 * | 10/2004 | Morizaki | H01R 12/675 439/387 |
| 2005/0227529 | A1 * | 10/2005 | Mrakovich | H01R 4/2433 439/402 |
| 2010/0186229 | A1 | 7/2010 | Enomoto et al. | |

* cited by examiner

CONNECTOR WITH SLIDING TAP

BACKGROUND

The disclosed embodiments relate generally to cables and connectors used in conjunction with network transmission media of the type used in industrial control, monitoring, and similar power and data network systems. More particularly, the disclosed embodiments relate to a novel modular connector for use with such a cable and associated network. The modular connector and cable are designed for use in an industrial-type control and monitoring system in which a number of device nodes receive various forms of power and data via the conductors in the cable via the conductor and associated interface.

Such power and data network systems typically include a number of device nodes coupled to a set of common conductors for transmitting power and data. The node devices often include both sensors and actuators of various types, as well as microprocessor-based controllers or other command circuitry. Power supplies coupled to the network furnish electrical energy via the network media to power interface devices and operate actuators, sensors, and other devices. In operation, devices on the network process the transmitted parameter data and command operation of networked devices as push-button switches, motor starters, proximity sensors, flow sensors, speed sensors, actuating solenoids, electrical relays, electrical contactors, and so forth.

The transmission of both power and data on the same cable presents several challenges, some of these being; reliably establishing a connection to the network, maintaining network continuity when de-coupling devices from the network, supplying additional power to an installed network, and mitigation of noise induced on the data conductors by the power conductors. Due to the nature of an industrial network as described, devices may be located at various points on the network for a given application. This necessitates the ability to quickly and reliably place connectors on a multi-conductor cable anywhere along its length. Additionally, it is desirable to maintain the electrical continuity of both the power and data transmitted on the network when a device is removed from a network. Given the fact that various forms of electrical power are provided to devices via the network cable, power will vary by application and changes made to existing applications it is desirable to have means by which to provide additional power to the network and its devices. And finally, unlike unpowered data networks, in the case of a network transmission media conveying various forms of electrical energy and data there is the increased potential for unwanted noise or interference between conductors due to the nature of energizing and de-energizing coils, the opening and closing of contacts of devices on the network, and the general environment in which the network may be located.

There is a need, therefore, for an improved network media connector and associated cable for use in industrial control networks and the like. More particularly, there is a need for a connector and associated cable that quickly and effectively establishes a connection and provides the ability to inject additional power onto the network, and includes separate power and signal conductors positioned to mitigate electrical noise.

BRIEF DESCRIPTION

The embodiments in the present disclosure describe a novel modular connector for power and data network systems. The connector comprises a lower body having at least one orientation key, where the lower body encloses a cavity containing a plurality of connectors where each connector corresponds and is electrically connected to two of an insulation displacement member of a plurality of insulation displacement members aligned in two rows along the top surface of the lower body. The connector also has an upper body, upper body having at least one fixed conductor severing device and one or more movable conductor severing devices acting upon selected conductors of the multi-conductor ribbon cable, upper body also having at least one orientation key, each orientation key positioned to receive a corresponding set of keying voids in a multi-conductor ribbon cable. When mated to an interface circuit board, the conductive path is through traces on the interface board to the connected device and other devices on the network.

DRAWINGS

These and other features, aspects, and advantages of the disclosed embodiments will become better understood when the following detailed description is read with reference to the accompanying drawings in which like characters represent like parts throughout the drawings, wherein:

FIG. 1 is a perspective drawing of an electromagnetic switching device with network interface;

FIG. 1*a* is a diagrammatical illustration of a device network including a number of nodes;

Figures 4A, 4B, 4C:
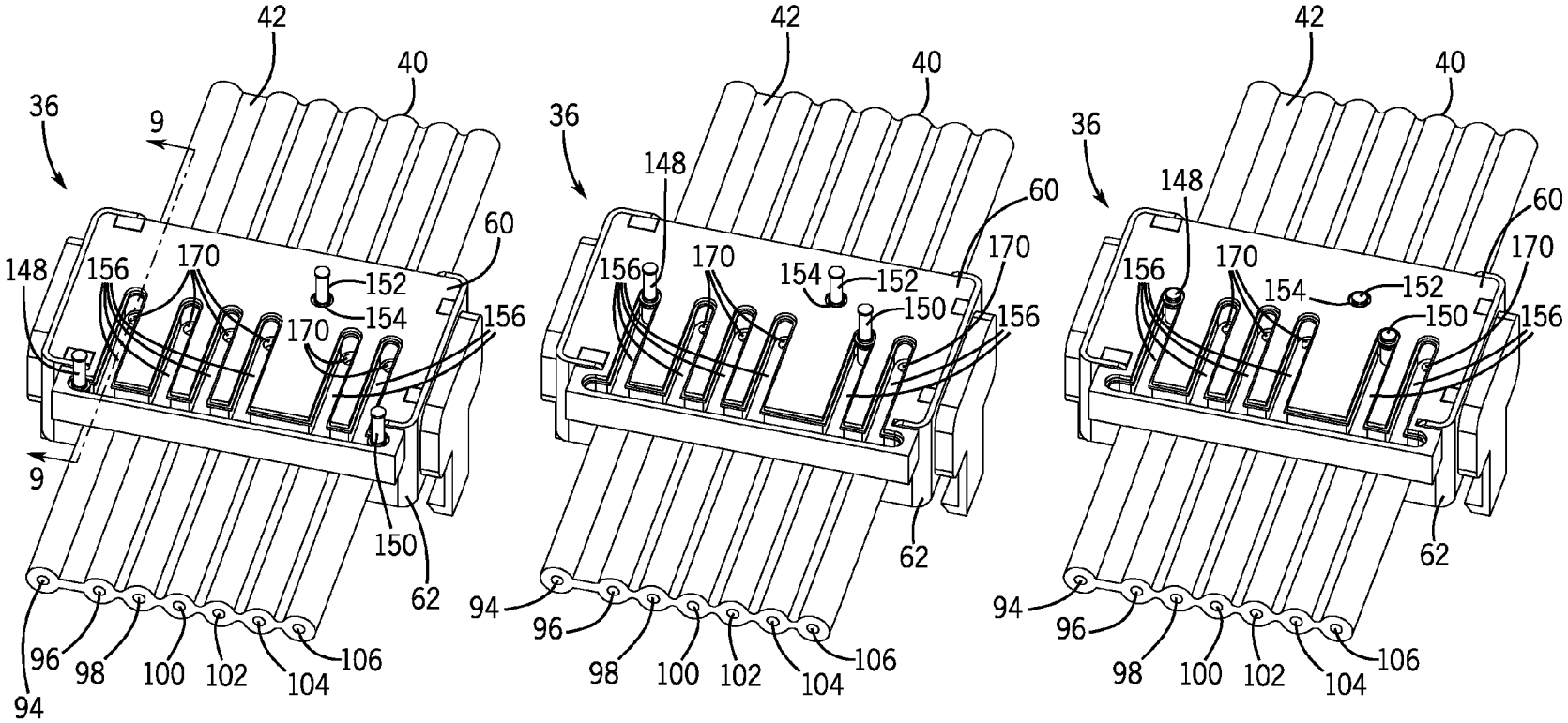
Figure 5:
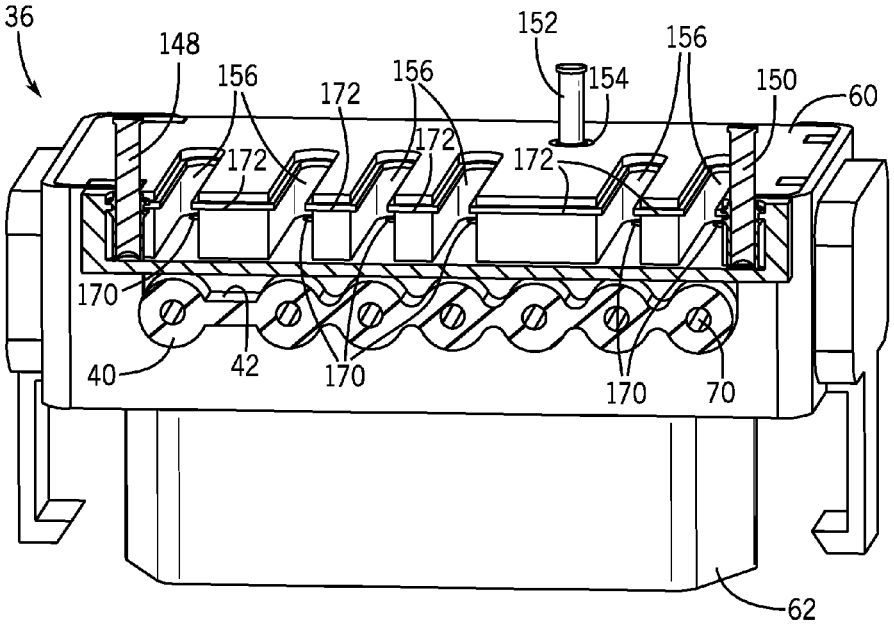
Figure 6A:
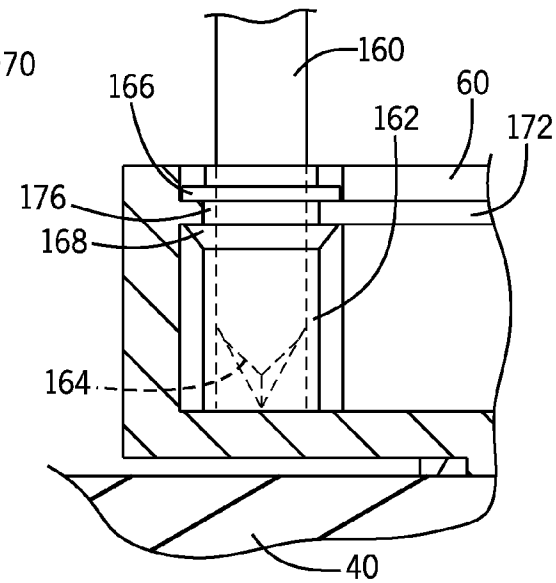
Figure 6:
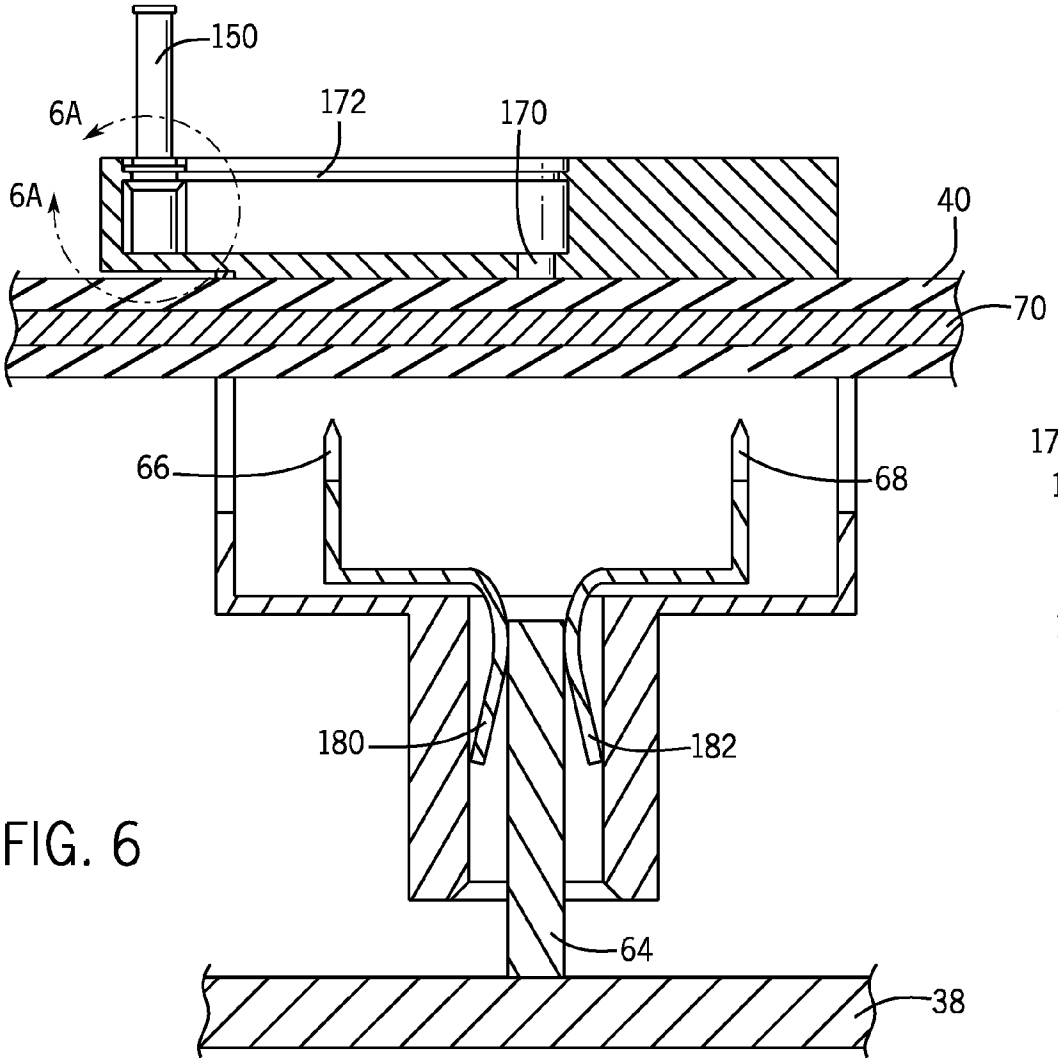
Figure 7:
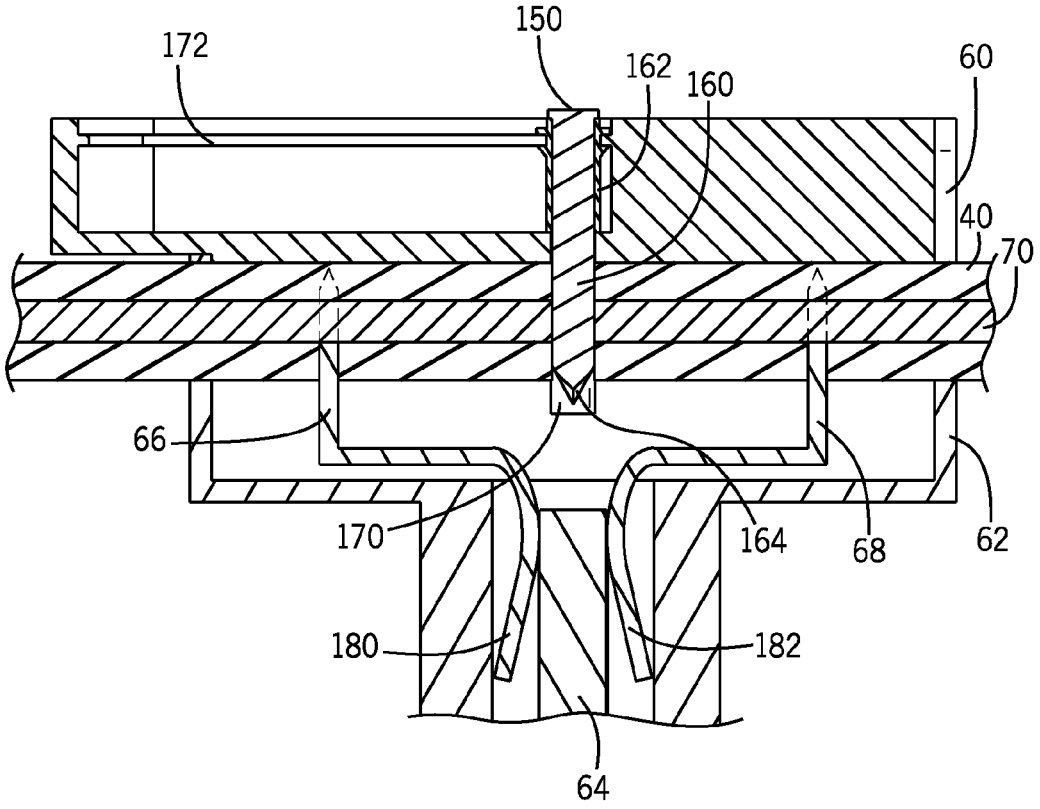
Figure 8:
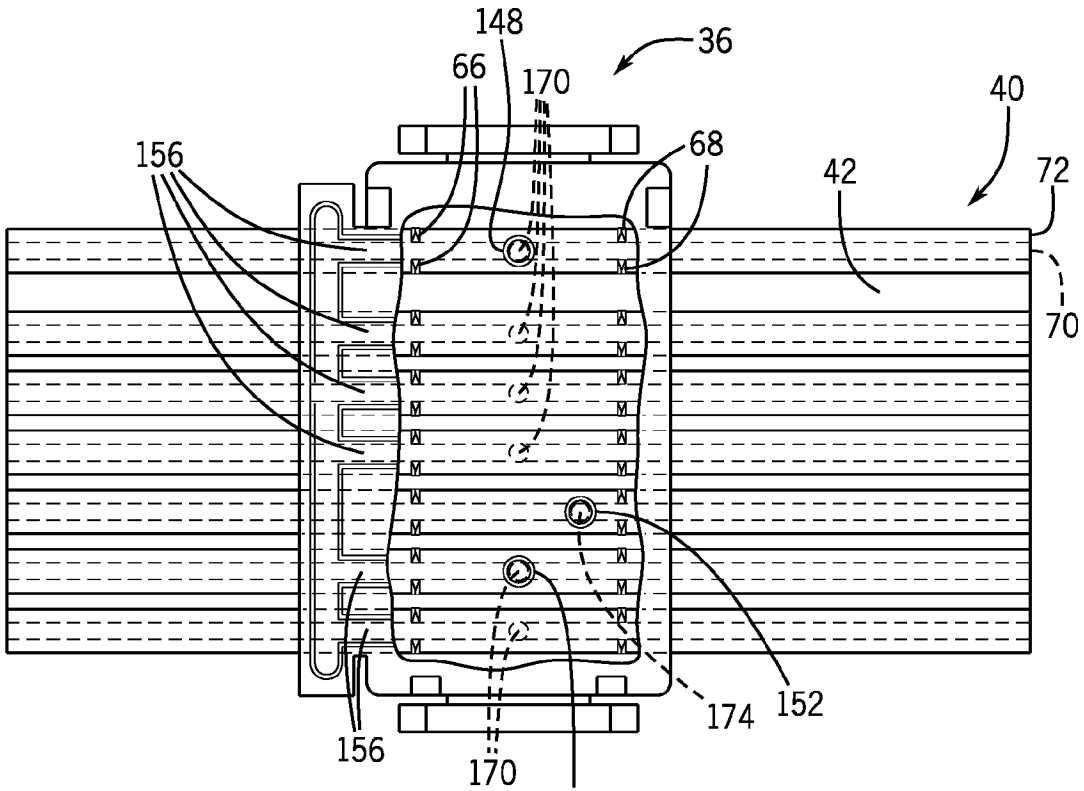
Figure 9:
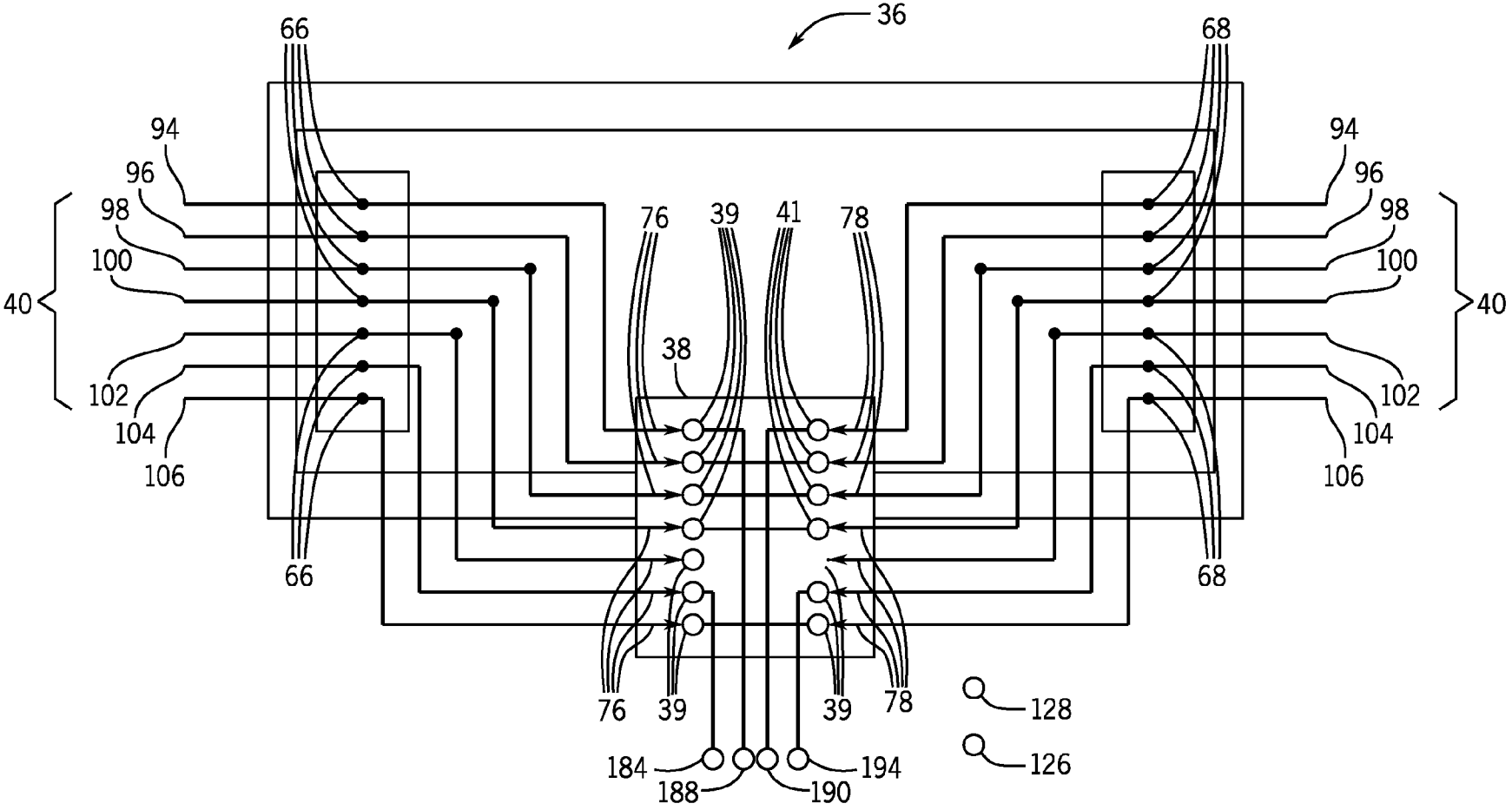
Figure 10:
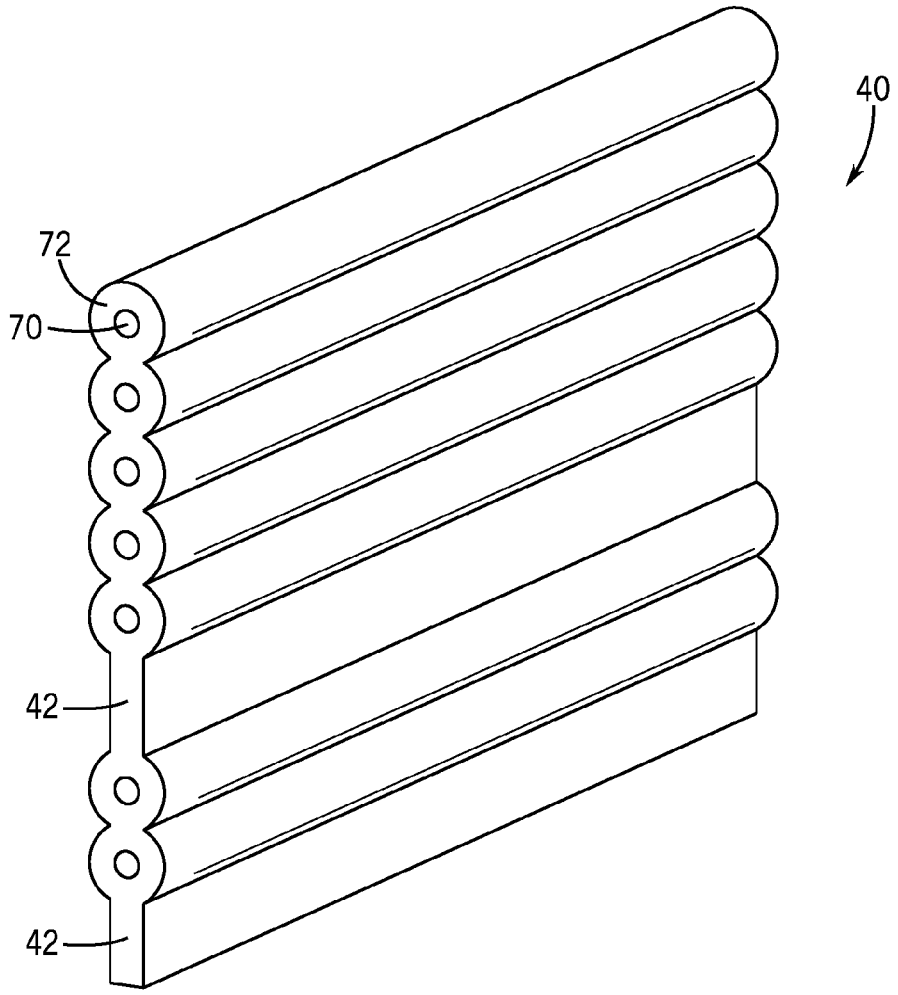
Figure 11:
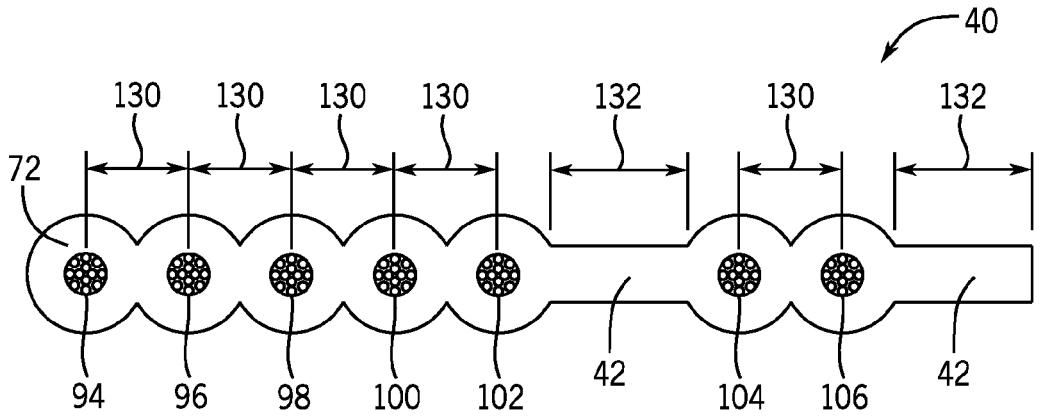

FIG. 4*a* is a perspective view of an embodiment of a connector in the pre-crimped state;

FIG. 4*b* is a perspective view of an alternate embodiment of a connector in the pre-crimped state;

FIG. 4*c* is a perspective view of an alternate embodiment of a connector in the crimped state;

FIG. 5 is a cutaway side view of an embodiment of a connector in the pre-crimped state;

FIG. 6 is a cutaway end view of an embodiment of a connector in the pre-crimped state;

FIG. 6*a* is a detail view of a portion of FIG. 6 illustrating the engagement of the punch in the connector in the pre-crimped state;

FIG. 7 is a cutaway end view of an embodiment of a connector in the crimped state;

FIG. 8 is a cutaway top view of connector and ribbon cable in the crimped state;

FIG. 9 is a schematic diagram of a connector in the plugged state;

FIG. 10 is a perspective view of a multi-conductor ribbon cable with keying voids; and FIG. 11 is an end view of a multi-conductor ribbon cable with keying voids.

DETAILED DESCRIPTION

Figure 1:
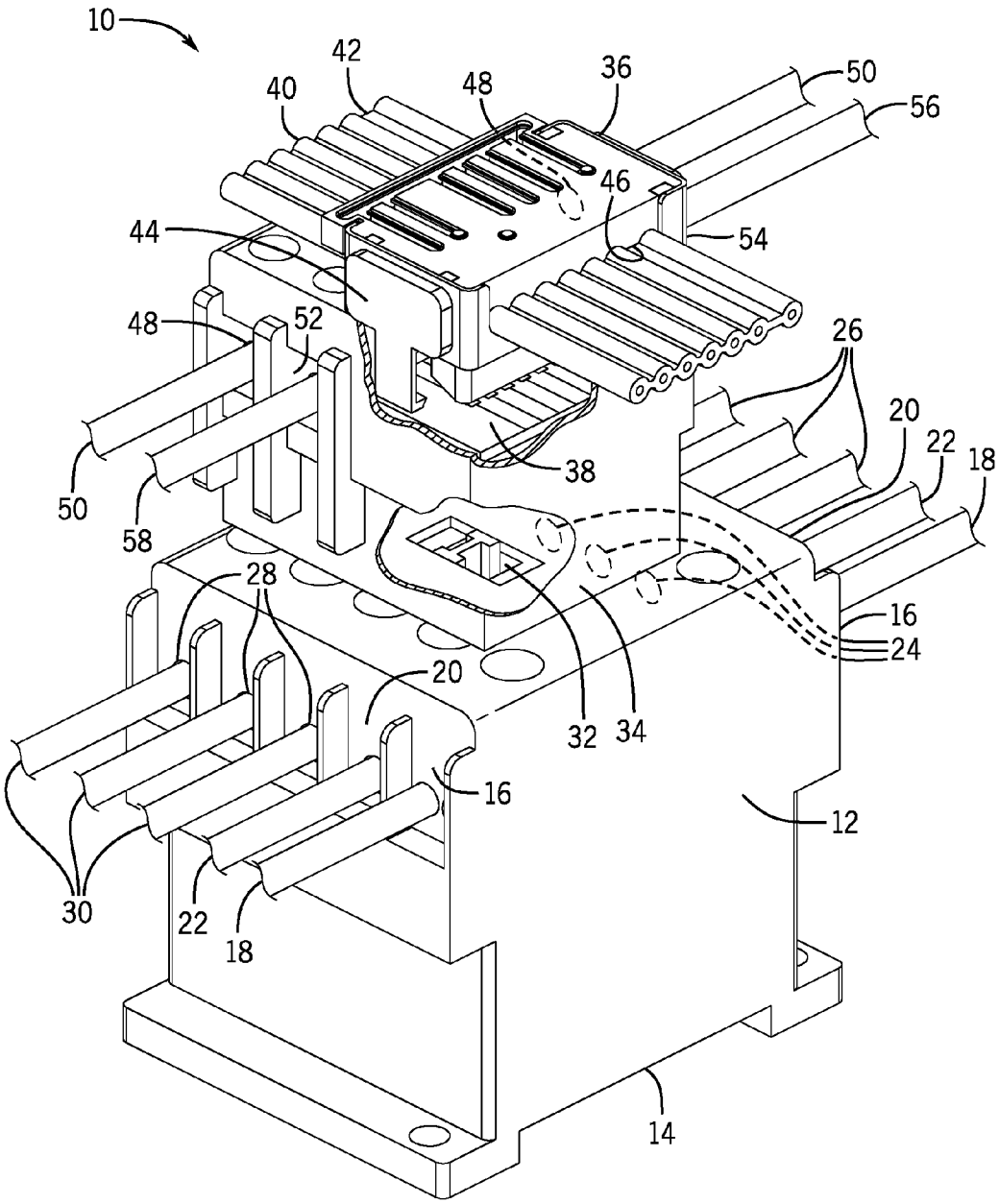

Turning now to the drawings, and referring to FIG. 1, a circuit interrupting device is illustrated in the form of an electromagnetic contactor with network interface 10 for controlling electrical current on multiple current carrying paths. The electromagnetic contactor with network interface 10 comprises an electromagnetic contactor 12 having a generally rectangular body providing a slot 14 therein for receiving a standard DIN rail along the transverse axis generally within the plane of the base. Electromagnetic contactor 12 has a number of electrically isolated contact sections each configured to receive electrical inputs via power input conductors 26 connected to power terminal blocks 24 and deliver electrical outputs to a load via load output conductors 30 connected to load terminal blocks 28 when the electromagnetic contactor 12 is placed in a state resulting in a completed electrical circuit. This state is controlled by passing an electric current through the electromagnetic coil contained within the device whose electrical connections are made accessible via the coil terminal blocks 16, the current being conveyed to the device via coil wires 18. Additionally, electromagnetic contactor 12 may include auxiliary contacts which are contained within the device, whose state changes in concert with that of the electromagnetic contactor 12. Electrical connections to these auxiliary contacts are made via auxiliary contact terminal blocks 20 with current conducted via auxiliary contact terminal wires 22.

Continuing with FIG. 1, in addition to an electromagnetic contactor 12, electromagnetic contactor with network interface 10 includes a network interface 34. Network interface 34 is coupled to electromagnetic contactor 12 and is actuated in unison via a mechanical interface 32 that mechanically couples the device to the network interface such that when the state of electromagnetic contactor 12 changes that of network interface 34 changes as well. Connector 36 is attached to printed circuit board 38 contained within network interface 34. In this particular embodiment connector 36 is secured to network interface 34 via a pair of latches 44 placed on each side of the connector and mating with a slot on network interface 34. It is conceivable that for some applications alternate embodiments of securing the attachment may include captive screws in place of the latches. In this particular embodiment, connector 36 is attached to ribbon cable 40 which provides power and data transmission to network interface 34 and similarly to associated devices on the network. Ribbon cable 40 contains a void 42 in the cable which matches an orientation key 46 on connector 36 in order facilitate the correct orientation of connector 36 when connecting to ribbon cable 40. It is important to note that the number of voids, their width, and position in the cable may vary depending upon the application without diverging from the intent of the disclosed embodiments.

In the embodiment illustrated in FIG. 1, network interface 34 provides electrical current to positive output terminal 52 and negative output terminal 54 where electrical current is obtained from conductors on ribbon cable 40 and provided via positive output terminal wire 56 and negative output terminal wire 58 to corresponding coil wires 18. This allows network interface 34 to control the state of electromagnetic contactor 12 via network signals on ribbon cable 40. Additionally, network interface 34 may include an auxiliary contact whose electrical interface is provided via network interface auxiliary contact terminal blocks 48 and associated electrical connections via network interface auxiliary contact terminal wires 50.

Figure 1A:
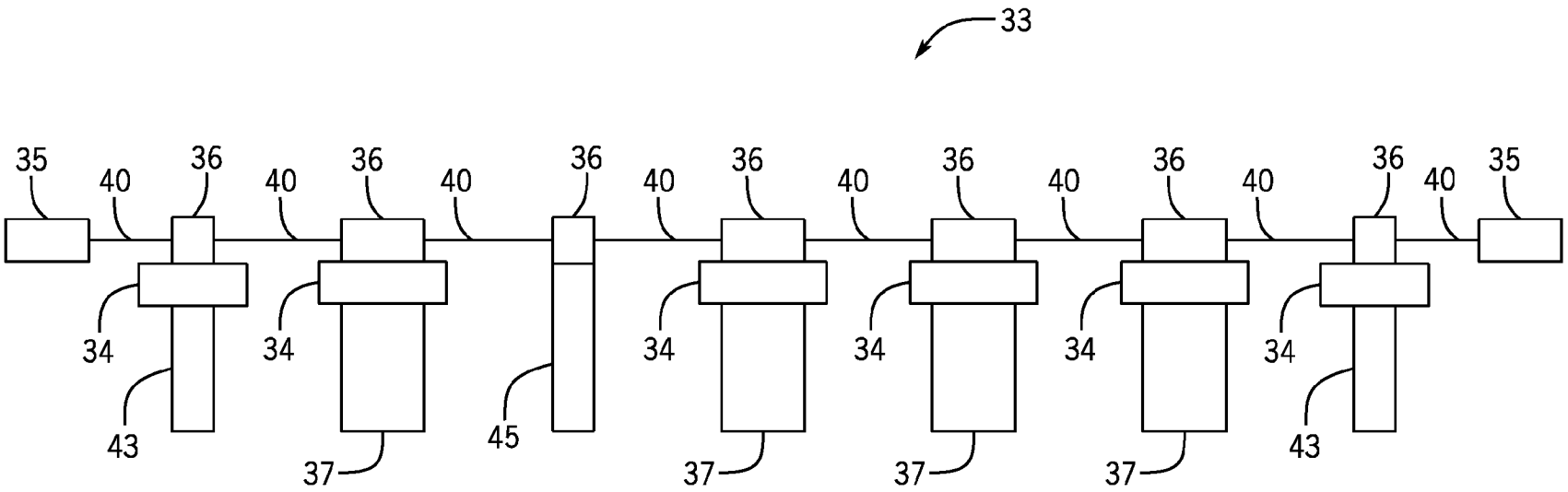

In FIG. 1*a* a data and power network is illustrated diagrammatically and designated generally by the reference numeral 33. The network includes a plurality of device nodes 37 coupled to one another via a network interface 34 and a network ribbon cable 40. One embodiment of a device node 37 is an electromagnetic contactor 12 and network interface 34 attached to ribbon cable 40 with connector 36 which is illustrated in FIG. 1 as electromagnetic contactor with network interface 10. Each device node 37 receives power and data signals from cable 40 via a modular connector 36 attached to network interface 34. At ends of cable 40 terminators 35 are provided for capping the cable ends and electrically terminating the signal conductors of the cable. Intelligent power taps 43 are connected to network 33 with connector 36 on network interface 34 via ribbon cable 40 for the purpose of providing electrical power to network 33 typically in the form of 24 volts DC. As illustrated, intelligent power taps 43 are intelligent devices having the ability to interact with the control and data signals of the network in addition to providing various forms of power. An alternate embodiment of a power tap could be a non-intelligent power tap 45. Non-intelligent power tap 45 only provides power to the network and thus connector 36 couples directly to non-intelligent power tap 45 with no need for network interface 34. Various embodiments of device node 37 may include devices such as push-button switches, motor starters, proximity sensors, flow sensors, speed sensors, actuating solenoids, electrical relays, electrical contactors, and so forth each adapted to receive an embodiment of network interface 34. As will be appreciated by those skilled in the art, each device node 37 may transmit and receive control and data signals via ribbon cable 40 in accordance with various standard protocols in addition to receiving various forms of electrical power.

Figure 2:
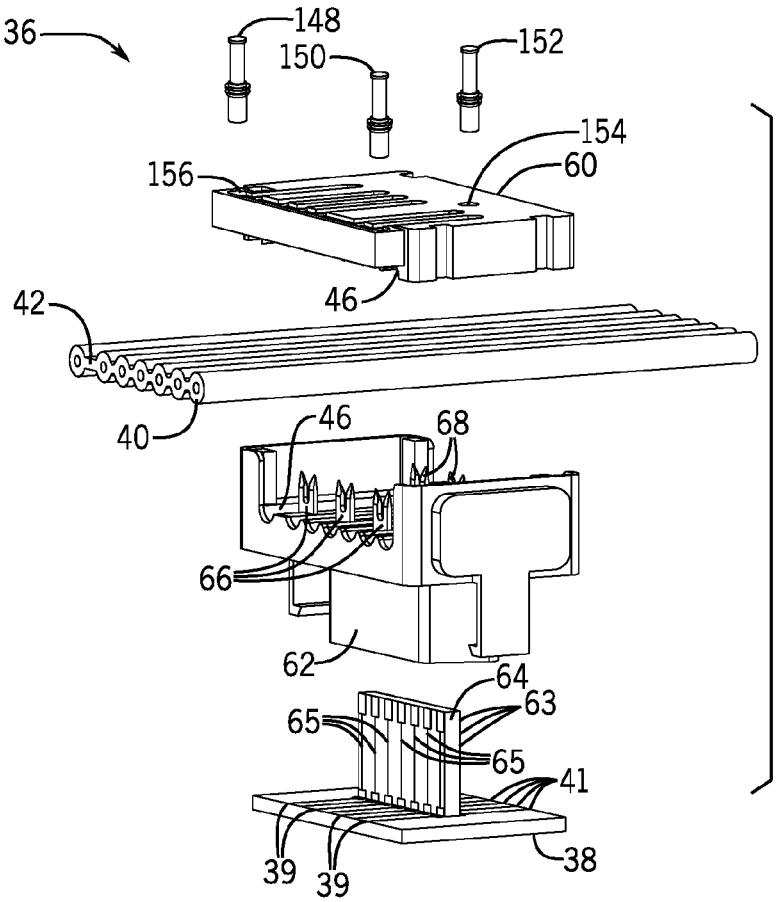
FIG. 2 is an exploded perspective view of a connector, ribbon cable, header board, and a network interface printed circuit board.

Considering FIG. 2, an exploded perspective view of connector 36, ribbon cable 40, and interface printed circuit board 38 is illustrated. Connector 36 comprises an upper portion 60 and lower portion 62. Upper portion 60 contains configuration channel 156 adapted to receive one or more moveable punches of which two are illustrated in this embodiment, moveable punch A 148 and moveable punch B 150. Moveable punch A 148 and moveable punch B 150 move within configuration channel 156 to various configuration positions that will be explained further on in this specification. Additionally, upper portion 60 contains fixed punch aperture 154 which is adapted to receive fixed punch 152. Ribbon cable 40 is located transversely between upper portion 60 and lower portion 62 such that when upper portion 60 and lower portion 62 are compressed together by a crimping tool a connection to each conductor contained within ribbon cable 40 is made via left insulation displacement members 66 and right insulation displacement members 68 which are typically configured such that there are two connections per conductor in the ribbon cable, one on the left and one on the right which is further illustrated in FIG. 7. Upper portion 60 and lower portion 62 of connector 36 have an orientation key 46 which aligns with cable void 42 of ribbon cable 40 in order to facilitate the correct orientation of connector 36 on ribbon cable 40. Orientation keys 46 provide a mechanism such that connector 36 is properly aligned with multi-conductor ribbon cable 40 during the crimping process. This ensures that the correct power and data signals of the conductors contained within multi-conductor ribbon cable 40 are electrically connected to the corresponding power and data signals of network interface 34. Connector 36 is attached to interface circuit board 38 via header board 64. Interface circuit board 38 includes a number of right interface circuit board traces 39 and left interface circuit board traces 41 that are electrically connected to right header circuit board traces 63 and left header circuit board traces 65 on header circuit board 64. It is easily conceivable by one skilled in the art that the both the number and configuration of the fixed and moveable punches as represented by fixed punch 152, moveable punch A 148, and moveable punch B 150 could vary by application.

Figure 3:
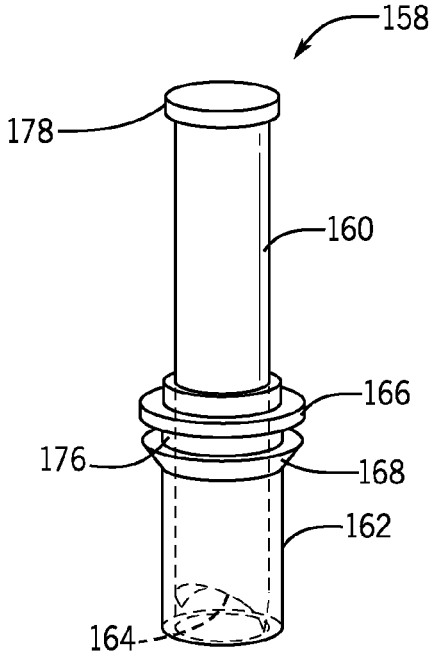
FIG. 3 is a detail view of a punch pin.

FIG. 3 is a detail view of the punch assembly 158. Punch assembly 158 represents the punches of upper portion 60 including fixed punch 152, moveable punch A 148, and moveable punch B 150. Punch assembly 158 comprises punch barrel 162 which is adapted to receive with a friction fit punch pin 160. Punch pin 160 is able to move vertically within the constraint of punch barrel 162 with punch top 178 preventing punch pin 160 from being pushed completely through punch barrel 162. The bottom of punch pin 160 comprises a punch blade 164 which severs conductors 70 in ribbon cable 40 and will be explained further on in this specification. Top engagement ring 166 and bottom engagement ring 168 are circumferentially adapted around punch barrel 162 forming punch engagement slot 176. The circumference of bottom engagement ring 168 is chamfered such that it can be snapped into configuration channel 156. Punch assembly 158 is held captive within configuration channel 156 by the operative engagement of the bottom edge of top engagement ring 166 and the top edge of bottom engagement ring 168. Punch assembly 158 is able to move in constrained lateral motion within configuration channel 156. It is important to note that FIG. 3 illustrates merely one potential embodiment of punch assembly 158. Other embodiments are conceivable by one skilled in the art without diverging from the intent of the disclosed embodiments.

Considering FIG. 4*a*, FIG. 4*b*, and FIG. 4*c* as a group the relationship of connector 36 and the parts of which it is comprised in relation to ribbon cable 40 are illustrated. Beginning with FIG. 4*a*, a perspective view of connector 36 just prior to the completion of the crimping operation is illustrated. Connector top 60 and connector bottom 62 have been joined but it is important to note that fixed punch 152, moveable punch A 148, and moveable punch B 150 are each in the uncrimped state. Portions of configuration channel 156 run in lateral relation to conductors 70 in ribbon cable 40. At the end of each lateral channel a punch receiving aperture 170 is located. Punch receiving aperture 170 is adapted to receive punch pin 160 of moveable punch A 148 and moveable punch B 150. Punch receiving apertures 170 are entirely through upper portion 60 such that punch blade 164 of punch pin 160 of moveable punch A 148 and moveable punch B 150 are allowed to contact conductors 70 of ribbon cable 40. Fixed punch aperture 154 is adapted to receive punch barrel 162 of fixed punch 152 allowing punch blade 164 of punch pin 160 of fixed punch 152 to move within punch barrel 162 and come into contact with conductor 70 of ribbon cable 40. As further illustrated in FIG. 4*b*, moveable punch A 148 and moveable punch B 150 have been placed into position in configuration channel 156 over punch receiving apertures 170. FIG. 4*b* and FIG. 4*c* illustrate possible configurations for moveable punch A 148 and moveable punch B 150. FIG. 4*c* illustrates fixed punch 152, moveable punch A 148, and moveable punch B 150 at the completion of the crimping operation. If moveable punch A 148 and moveable punch B 150 are not required for the application they can remain in the outer position as shown in FIG. 4*a* and will not be crimped during the crimping operation.

Turning to FIG. 5, a side perspective view with a partial cutaway of connector 36 is shown in the state just prior to the completion of the crimping operation as indicated by the fact that upper portion 60 and lower portion 62 are coupled and fixed punch 152, moveable punch A 148, and moveable punch B 150 remain in the uncrimped state. This view illustrates rail 172 which encompasses the entire perimeter of configuration channel 156 and is the mechanism used to retain moveable punch A 148 and moveable punch B 150 and define their movement within configuration channel 156. Additional detail is provided in FIG. 6 and FIG. 6*a*.

Continuing with FIG. 6 with additional detail provided in FIG. 6*a*, a cutaway end view of connector 36 is illustrated. In this view upper portion 60 and lower portion 62 are in the uncrimped state and ribbon cable 40 is located transversely between upper portion 60 and lower portion 62. In this view connector 36 is coupled to header board 64. As depicted in FIG. 2 header board 64 makes electrical contact with interface circuit board 38 via right header board traces 63 connected to right interface board traces 41 and left header board traces 65 connected to left interface board traces 39. Left connector contact 180 makes contact with left header board traces 65 and right connector contact 182 makes contact with right header board traces 63 and in turn interface circuit board 38 as part of network interface 34 as described. In the illustrated embodiment the flow of power and data signals on multi-conductor ribbon cable 40 is interrupted when connector 36 is removed from network interface 34. It is easily conceivable by one skilled in the art that some applications may require that the flow of power and data signals on multi-conductor ribbon cable 40 not be interrupted when connector 36 is removed from network interface 34. In this alternate embodiment, each of right connector contact 182 and left connector contact 180 may be replaced by corresponding pairs of spring contacts that maintain a conductive path when connector 36 is de-coupled from network interface 34.

In FIG. 7 a cutaway end view of connector 36 is shown with upper portion 60 and lower portion 62 in the fully crimped state. In this particular illustration moveable punch B 150 is shown in the fully crimped state as well. In this state punch pin 160 has traveled through punch barrel 162 with punch blade 164 severing conductor 70 of ribbon cable 40. A similar sequence occurs with moveable punch A 148 and fixed punch 152 as illustrated in FIG. 4*c*. Additionally, in the fully crimped state each conductor 70 of ribbon cable 40 is pierced by a set of left insulation displacement members 66 and right insulation displacement members 68. A cutaway top view of connector 36 in the fully crimped state is further illustrated in FIG. 8. As described, each conductor 70 of ribbon cable 40 is pierced by a corresponding pair of left insulation displacement members 66 and right insulation displacement members 68. The fully crimped connector 36 coupled with header board 64 and interface circuit board 38 is further illustrated in FIG. 8.

Referring to FIG. 9, a schematic illustration of connector 36 engaged with ribbon cable 40 is shown. In this particular embodiment the electrical signals passing through connector 36 may be assigned as shown in the following table, table 1:

| Conductor element number | Electrical Signal |
|---|---|
| 94 | Switched Power Positive 140 |
| 96 | Switched Power Negative 142 |
| 98 | Network Signal Positive 144 |
| 100 | Network Signal Negative 146 |
| 102 | Discovery 134 |
| 104 | Network Power Positive 136 |
| 106 | Network Power Negative 138 |

For the purpose of further explanation, the signal assignment embodiment of table 1 corresponds to that of FIG. 4*c*.

The number of conductors 70 in ribbon cable 40 is seven for the exemplary network embodiment. It is conceivable that the number, types, and ordering of electrical power and signals carried by conductors 70 in ribbon cable 40 could vary widely for a given application without diverging from the intent of the disclosed embodiments. For instance, the choice of assigning signals to particular conductors 70 in ribbon cable 40 may be done so as to increase noise immunity, minimizing electromagnetic interference (EMI) between the conductors and the signals that they carry. Conceivable embodiments include separating power signals from network signals using one or more keying voids 42 between corresponding conductors or placing switched power conductors in distal relation to other conductors. For a given embodiment it is desirable to allow some of the electrical signals contained on each conductor 70 of ribbon cable 40 to pass unaltered or bypassed through the combination of connector 36, header board 64, and interface circuit board 38 while other signals may be altered or suspended.

As illustrated, the signal Discovery 134 is assigned to conductor 102 of ribbon cable 40 and is passed to interface circuit board 38 via associated left insulation displacement member 66 with the signal returned on the associated right insulation displacement member 68. Network Power Negative 138, Switched Power Negative 142, Network Signal Positive 144, and Network Signal Negative 146 are assigned to the conductor indicated in table 1 and are passed through connector 36 unaltered. In some embodiments it is conceivable that left insulation displacement member 66 and right insulation displacement member 68 associated with the assigned conductor 70 for each of Network Power Negative 138, Switched Power Negative 142, Network Signal Positive 144, and Network Signal Negative 146 may be removed from connector lower portion 62 of connector 36 as the associated power and signals are passed through connector 36 unaltered.

Continuing with FIG. 9 and referring to FIG. 4*c*, Switched Power Positive 140 is assigned to conductor 94 of ribbon cable 40. As a consequence of the completed crimping operation, conductor 94 has been operatively engaged by associated left insulation displacement member 66 and right insulation displacement member 68 and moveable punch A 148 has severed conductor 94. This provides the ability to inject additional Switched Power Positive 140 onto data and power network 33 via connections 188 and 190 on interface circuit board 38 as required for a given application. Discovery signal 134 has been assigned to conductor 102 which has been operatively engaged by associated left insulation displacement member 66 and right insulation displacement member 68 and fixed punch 152 has severed conductor 102 connecting Discovery signal 134 to interface circuit board 38. Network Power Positive 136 has been assigned to conductor 104 which has been operatively engaged by associated left insulation displacement member 66 and right insulation displacement member 68 and moveable punch B 150 has severed conductor 104. This provides the ability to inject additional Network Power Positive 136 onto data and power network 33 via connections 184 and 194 on interface circuit board 38 as required for a given application.

Electrical connections to connection points 184, 188, 190, and 194 may be established by any number of means including but not limited to jumpers on pin headers, Dual In-Line Package (DIP) switches, relays, or semiconductor switching devices. Additionally, it is conceivable that configuration information may be written to network interface 34 via network 33 through the use of a computer running a configuration software program. Any number of combinations of signals being passed through, altered, enhanced, or suspended is conceivable for any device on network 33 whether that is a device node 37 or an intelligent power tap 43. Generally stated the method of signal selection would include the following steps of determining the number and type of devices 37 required for an application, calculating the network power requirements, calculating the switched power requirements, selecting the number of intelligent power taps 43 and non-intelligent power taps 45 required to meet network and switched power requirements, determining the distribution of intelligent power taps 43 and non-intelligent power taps 45 on network 33, positioning a plurality of devices 37, intelligent power taps 43, and non-intelligent power taps 45 on network 33, setting configurable circuit completing devices in network interface 34, mechanically coupling a network interface 34 to a plurality of devices 37 and intelligent power taps 43, configuring positions of moveable punch A 148 and moveable punch B 150, on a plurality of connectors 36, mechanically coupling a connector 36 to each of a plurality of network interface 34 on devices 37 and intelligent power taps 43, and non-intelligent power taps 45. It is important to note that various combinations of the presence or absence of one or more orientation keys 46 and their position in connector 36 in relation to multi-conductor ribbon cable 40, in combination with the number of fixed punch 152, moveable punch A 148, and moveable punch B 150 could be used to meet the requirements of an application. In addition to the various embodiment choices of the ribbon cable, orientation keys, and both fixed and moveable punches, additional embodiments may result from the combination of intelligent and non-intelligent taps and the combination of choices with regard to signals being passed through, altered, enhanced, or suspended in order to meet the requirements of a given application. The described embodiments are just some of a number of possible embodiments that could be conceived by a person skilled in the art.

Finally, FIG. 10 illustrates ribbon cable 40 with additional detail provided in FIG. 11. As previously described, ribbon cable 40 includes network signal conductors and power conductors disposed generally parallel to one another in a common plane. In reference to the signal assignments in table 1 above, FIG. 11 illustrates Switched Power Positive 140 on conductor 94, Switched Power Negative 142 on conductor 96, Network Signal Positive 144 on conductor 98, Network Signal Negative 146 on conductor 100, Discovery 134 on conductor 102, Network Power Positive 136 on conductor 104, and Network Power Negative 138 on conductor 106. Discovery 134, Network Signal Positive 144, and Network Signal Negative 146 are network signal conductors. Network Power Positive 136, Network Power Negative 138, Switched Power Positive 140, and Switched Power Negative 142 are power signals. The preferred structure of ribbon cable 40 and the advantages flowing from the preferred structure include an insulative cover or jacket 72 encapsulating the signal and power conductors, insulator 72 narrows to form a reduced thickness physical key or void 42 which corresponds to the placement of orientation key 46 on connector 36, thereby ensuring that each network connector 36 is properly and uniformly positioned with respect to the conductors carried within ribbon cable 40 during installation. The number, width 132, and position of physical key or void 42 on ribbon cable 40 could vary without deviating from the intent of the disclosed embodiments. Additionally, as previously described, within ribbon cable 40, conductors 94-106 and the network signals or power that they conduct in any given embodiment may be assigned or ordered in such a way so as to minimize electromagnetic interference (EMI.) It could also be conceived by a person skilled in the art to vary the spacing 130 between conductors 94-106 so as to provide further immunity to noise especially between signal conductors and power conductors.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosed embodiments.

The invention claimed is:

1. A connector for a multi-conductor power and data transmission network ribbon cable for use with a network, the network including a plurality of devices configured to be coupled to one another via the cable, the connector comprising: a lower body enclosing a cavity containing a plurality of connectors, each connector corresponding and electrically connected to two insulation displacement members of a plurality of insulation displacement members forming first and second rows; an upper body having a fixed severing device positioned within the upper body in alignment with a conductor of the multi-conductor ribbon cable, a plurality of configuration channels supporting and horizontally constraining one or more moveable severing devices where each configuration channel is aligned with some of the conductors of the multi-conductor cable, wherein all severing devices are movable from an initial uncrimped state to a final crimped state, the upper body adapted to engage the multi-conductor ribbon cable between the upper body and lower body.

2. The connector of claim 1, wherein the upper body and the lower body have at least one orientation key, the orientation keys defining a space configured to receive the multi-conductor ribbon cable in corresponding keyed orientation.

3. The connector of claim 1, wherein a multi-conductor cable is adapted to receive at least one orientation key on opposing sides.

4. The connector of claim 1, wherein each conductor of the multi-conductor ribbon cable is brought into electrical contact with conductor engaging portions of two opposing insulation displacement members.

5. The connector of claim 4, wherein the insulating jacket of the multi-conductor ribbon cable is sufficiently resilient to permit piercing by insulation displacement members.

6. The connector of claim 4, wherein the insulating jacket of the multi-conductor ribbon cable has a first thickness surrounding conductors, a second thickness between adjacent conductors, and a third thickness for receiving orientation keys.

7. The connector of claim 4, wherein the conductors of the multi-conductor ribbon cable are disposed parallel to one another in a common plane with signal conductors at a first distance and power conductors at a second distance.

8. The connector of claim 4, wherein the conductors of the multi-conductor ribbon cable are disposed parallel to one another in a common plane ordered such that power conductors do not electrically couple with signal conductors.

9. The connector of claim 1, wherein the connector is configured to receive an edge connector on a printed circuit board.

10. A connector for a power and data transmission network cable, a network including a plurality of nodes configured to be coupled to one another via the cable, the connector comprising:

an upper body and a lower body each having at least one orientation key adapted to receive a multi-conductor ribbon cable, the lower body having a receiving cavity;

a multi-conductor ribbon cable adapted to receive orientation keys transversely positioned between the upper body and the lower body whose conductors are electrically coupled to insulation displacement members on the lower body;

a plurality of configuration channels in the upper body aligned in correspondence with some of the conductors of the multi-conductor ribbon cable, supporting and horizontally constraining one or more moveable severing devices;

at least one severing device positioned within the upper body aligned with one conductor of the multi-conductor ribbon cable;

wherein all severing devices are movable from an initial uncrimped state to a final crimped state.

11. The connector of claim 10, wherein conductors may have additional electrical power injected.

12. The connector of claim 10, wherein conductors may be altered or suspended.

13. The connector of claim 10, wherein conductors may be passed unaltered.

14. The connector of claim 10, wherein the connector is configured to receive an edge connector on a printed circuit board.

15. The connector of claim 11, wherein the printed circuit board contains one or more connectors for electrical power.

16. An industrial control network connector system comprising:

an upper body having at least one orientation key adapted to receive a multi-conductor cable, a severing device within the upper body in alignment with a conductor of the multi-conductor cable, a plurality of configuration channels supporting and horizontally constraining one or more moveable severing devices where each configuration channel is aligned with some of the conductors of the multi-conductor cable, wherein all severing devices are movable from an initial uncrimped state to a final crimped state, and a lower body having at least one orientation key adapted to receive the multi-conductor cable, the lower body having a receiving cavity adapted to receive an interface circuit board;

a plurality of connectors arrayed in opposing pairs in the receiving cavity each electrically connected to one of a plurality of insulation displacement members;

a multi-conductor cable adapted to receive orientation keys transversely positioned between the upper body and the lower body whose conductors are electrically coupled to insulation displacement members on lower body when upper body and lower body are operatively engaged;

an interface circuit board having conductive traces on opposing sides in corresponding relation to connectors wherein upon coupling with lower body opposing connectors are placed in contact with conductive traces;

a network interface coupled to an industrial control device having a surface adapted to receive the network device in operative engagement.

17. The connector system of claim 16, wherein the industrial control device is selected from the group consisting of push-button switches, motor starters, proximity sensors, flow sensors, speed sensors, actuating solenoids, electrical relays, and electrical contactors.

18. The connector system of claim 16, wherein network interface and industrial control device are mechanically coupled for operative engagement.

19. The connector system of claim 16, wherein the network interface controls the state of the industrial control device by network signals.

20. The connector system of claim 16, wherein the network interface obtains network power and system power from the multi-conductor cable.

* * * * *